US006210205B1

(12) United States Patent
Huang

(10) Patent No.: US 6,210,205 B1
(45) Date of Patent: Apr. 3, 2001

(54) SPACER FOR IDC TERMINATION

(75) Inventor: Wayne Huang, Alhambra, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/374,397

(22) Filed: Aug. 13, 1999

(51) Int. Cl.[7] ..... H01R 4/24
(52) U.S. Cl. ..... 439/405
(58) Field of Search ..... 439/405, 404, 439/417

(56) References Cited

U.S. PATENT DOCUMENTS 5,761,805 * 6/1998 Guyer ..... 28/883
5,951,321 * 9/1999 Jaag ..... 439/405
6,062,896 * 6/1998 Huang ..... 439/405

* cited by examiner

*Primary Examiner*—Gary F. Paumen
(74) *Attorney, Agent, or Firm*—Wei Te Chung

(57) ABSTRACT

A carrier for terminating conductors of conductive wires to insulation displacement sections of terminals molded in a housing of a connector by assembling said carrier carrying cables therein to a terminating face of said housing, comprises an elongate base defining upper, lower, front and rear faces. An array of mounting channels extends between said front and rear faces. An array of slits is defined in said bottom face and each communicates a corresponding channel. During termination between the conductors and the insulation displacement sections, each insulation displacement section is supportably guided within the slit before the insulation displacement sections engage with the cables thereby facilitating reliable termination therebetween.

1 Claim, 5 Drawing Sheets

SPACER FOR IDC TERMINATION

FIELD OF THE INVENTOR

The present invention relates to a spacer, and more particularly to a spacer for use with an IDC connector for ensuring termination between conductors of cables and insulation displacement section of terminals.

DESCRIPTION OF PRIOR ART

Conventionally, terminals are assembled to passageways defined in a housing through interferential fit therebetween. In order to securely assemble the terminal to the corresponding passageway, a body portion of the terminal is formed with barbs which anchor to walls of the passageway. In the very beginning, the pitch between two adjacent terminals provides enough room which effectively prevent a short circuit therebetween. For example, the width of the terminal is about 0.4 mm and the height of the barbs formed thereon is 0.1 mm. If the pitch is 1.27 mm, then the spacing between sides of the terminals equals to 1.27–0.2–0.2=0.87 (mm) [0.2 is a half of the width of the terminal], while the spacing measured from two adjacent barbs equal to 0.87–0.1–0.1=0.67 (mm). The terminals can be assembled to the corresponding passageways through interferential fit and the arrangement can pass the Direct Withstanding Voltage Test. However, the barbs or the likes formed on the body portion of the terminal will increase the insertion force. In addition, when the pitch reduces to 0.8 mm (very high density [VHD] connectors), then the spacing between two adjacent terminals equals to 0.8–0.2–0.2=0.4 (mm). In this case, it is impossible to assemble the terminals to the corresponding passageways through interferential fit because the spacing between two adjacent barbs equals to 0.4–0.1–0.1=0.2 (mm). The arrangement can not pass the Direct Withstanding Voltage Test because short circuit between two adjacent terminals will occur.

One of the solutions for such VHD connector is by insert molding which features high precision, reliability, and low labor cost. Furthermore, the body portion of the terminal can be formed with dimples to increase the retention within the enclosed housing. However, alignment of each terminal within a mold cavity is a problem which complicates the molding process as well as the mold configuration.

U.S. Pat. No. 5,761,805 discloses a plurality of channels (138) formed adjacent to the insulation displacement sections (32, 34). The conductive wires (24) are seated in the channels (138) after termination. However, during termination the insulation displacement sections (32, 34) are not well supported and vulnerable to fall down when excessive forces are experienced.

U.S. Pat. No. 6,062,896 issued May 16, 2002 assigned to the same assignee, entitled to "Method For Terminating Connector" describes a spacer used to terminate conductors to IDC sections of terminals. The specification is enclosed for reference. The disclosed spacer includes a base having a plurality of retaining slots for retaining conductive wires therein for facilitating reliable termination. Even each insulation displacement section is well supported, the retaining force provided by the open slot is still not enough during termination. If the conductive wires are not securely retained, termination thereof will displace the conductive wire.

SUMMARY OF THE INVENTION

An objective of this invention is to provide a spacer for terminations wherein conductors of wires are securely arranged in the spacer and during the terminations, insulation displacement section of terminals are well supportably guided thereby preventing the insulation displacement section from falling down.

In order to achieve the objective set forth, a carrier for terminating conductors of conductive wires to insulation displacement sections of terminals molded in a housing of a connector by assembling said carrier carrying conductive wires therein to a terminating face of said housing, comprises an elongate base defining upper, lower, front and rear faces. An array of channels extends between the front and rear faces. An array of slits is defined in the lower face in a direction traverse to the channels and each communicates a corresponding channel. An array of retaining slots defined in the lower face and each retaining slot is in alignment with a corresponding one of the channels. During termination between the conductors and the insulation displacement sections, each insulation displacement section is securely supported within the corresponding slit before the insulation displacement sections engage with the cables thereby facilitating reliable termination therebetween.

These and additional objects, features, and advantages of the present invention will become apparent after reading the following detailed description of the preferred embodiments of the invention taken in conjunction with the appended drawing.

DETAILED DESCRIPTION OF PREFERRED EMBODIMENT

Figure 1:
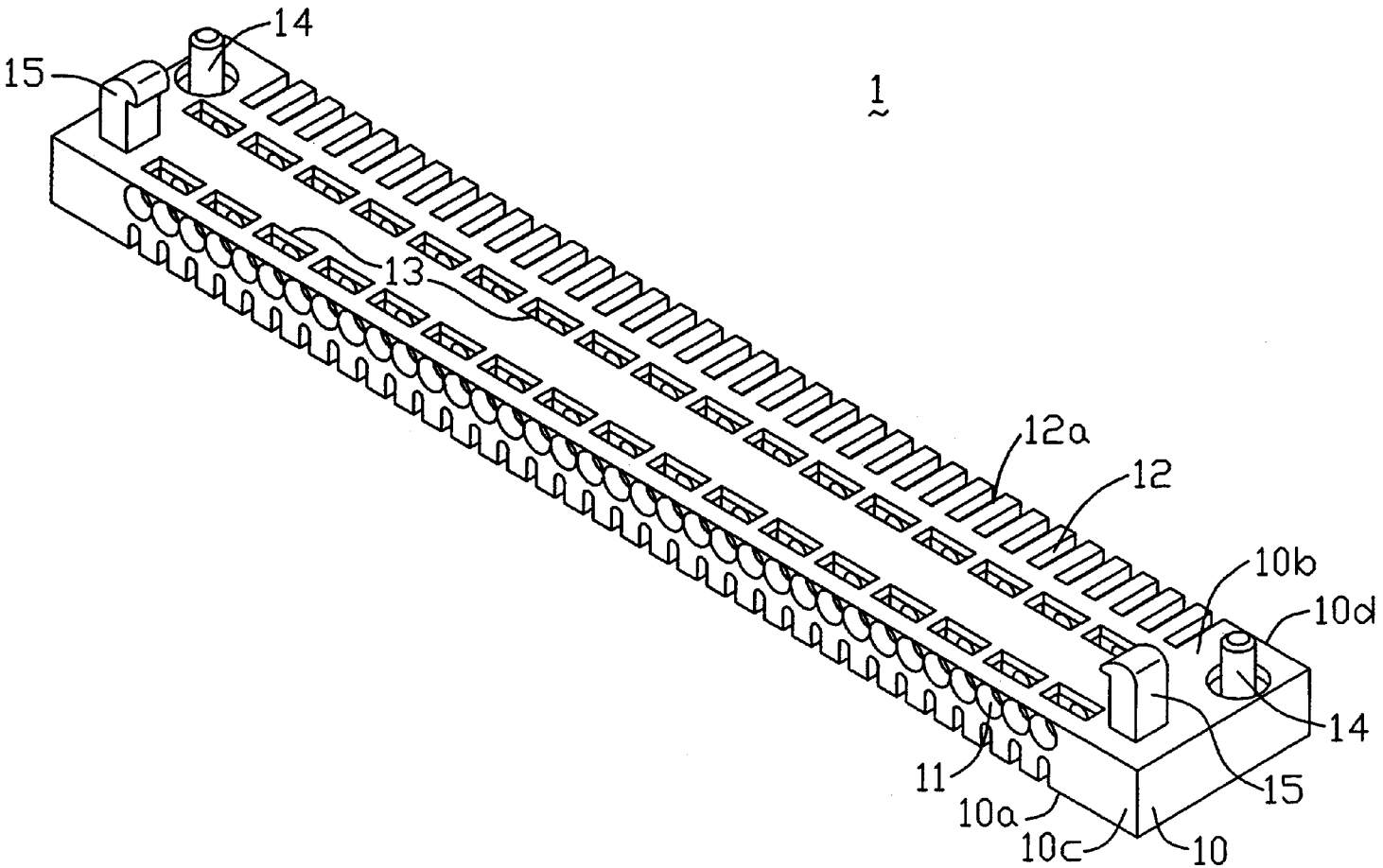
FIG. 1 is a perspective view of a perspective view of a spacer in accordance with the present invention.
Figure 2:
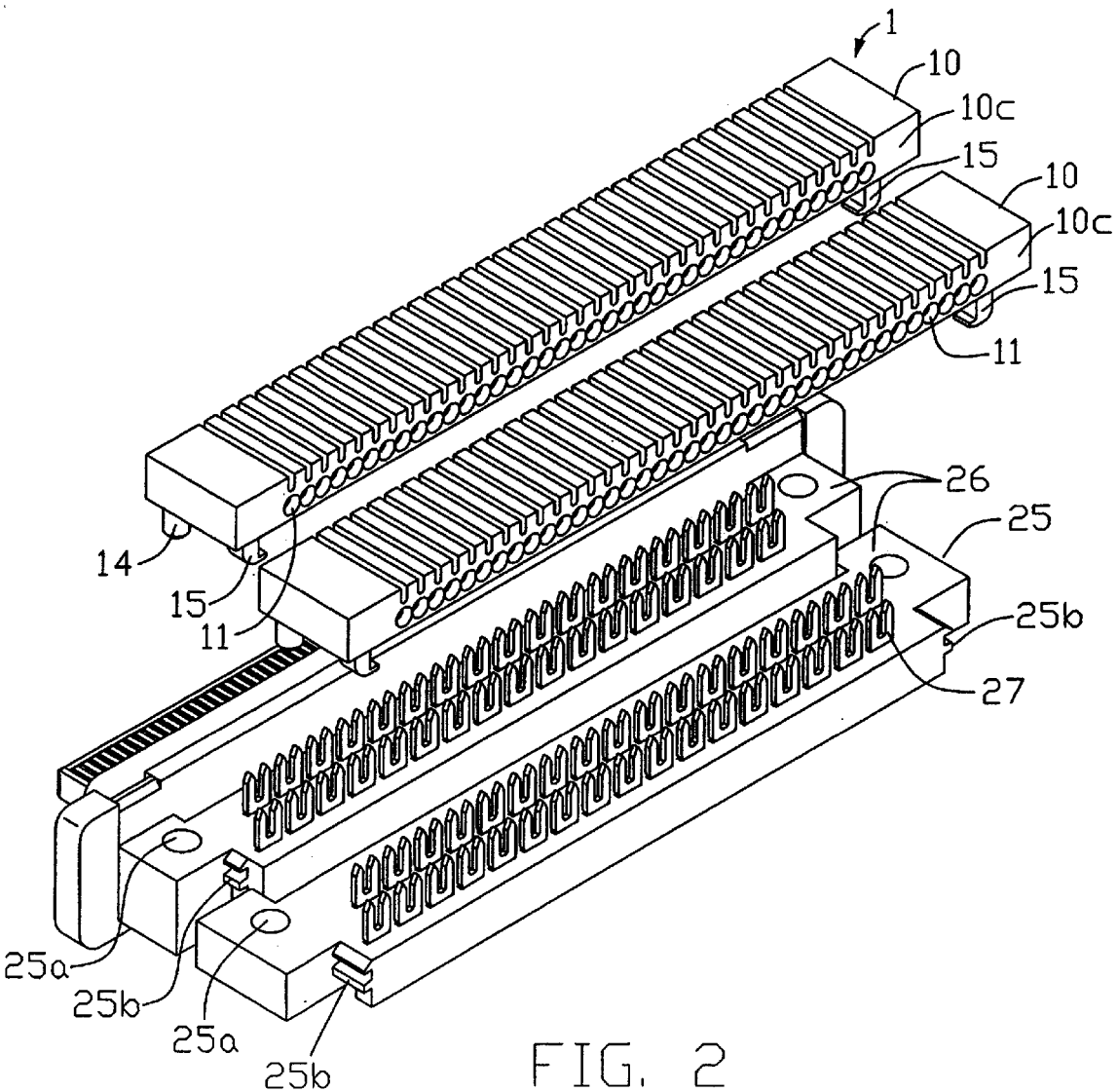
FIG. 2 is an exploded view of a connector core and two spacers.

Referring to FIGS. 1 and 2, a spacer 1 in accordance with the present invention comprises an elongate base 10 defining an upper face 10*a*, a lower face 10*b* opposite the upper face 10*a*, and front and rear faces 10*c* and 10*d*. An array of channels 11 is defined in the front face 10*a*. In the instant embodiment, the channels 11 extend about two third of the width of the base 10. An array of retaining slots 12 is defined in the lower face 10*b* and each in alignment with the corresponding channel 11. The inner diameter of the channel 11 is dimensioned such that a conductive wire 30 can snugly insert therein. However, the width of a front end 12*a* of the retaining slot 12 is slightly smaller than an outer diameter of the conductive wires 30, therefore when the conductive wire 30 extends through the channel 11, a free end of the conductive wire 30 can be securely retained by the front end 12*a* of the retaining slot 12. As a result, the conductive wire 30 will not be displaced during terminations. An array of slits 13 is defined in the lower face 10*b* and each communicates a corresponding channel 11. In the instant embodiment, there are two rows of slits 13 and which are offset from each other. By this arrangement, two adjacent channels 11 are corresponding respective slits 13 in different rows.

The base 10 further forms a pair of guiding posts 14 and a pair of latches 15 for engaging with holes 25*a* and hooks

25*b* of a connector core 25 of a connector. Description of function of the guiding posts 14 and the latches 15 are detailedly described in the co-pending application and no description is given therefor. By the provision of the guiding posts 14 and the latches 15, the spacer 1 can be assembled to the connector core 25. The connector core 25 has a terminating face 26 on which an array of insulation displacement section 27 extending therethrough. Please refer to the co-pending application for details.

Figure 3:
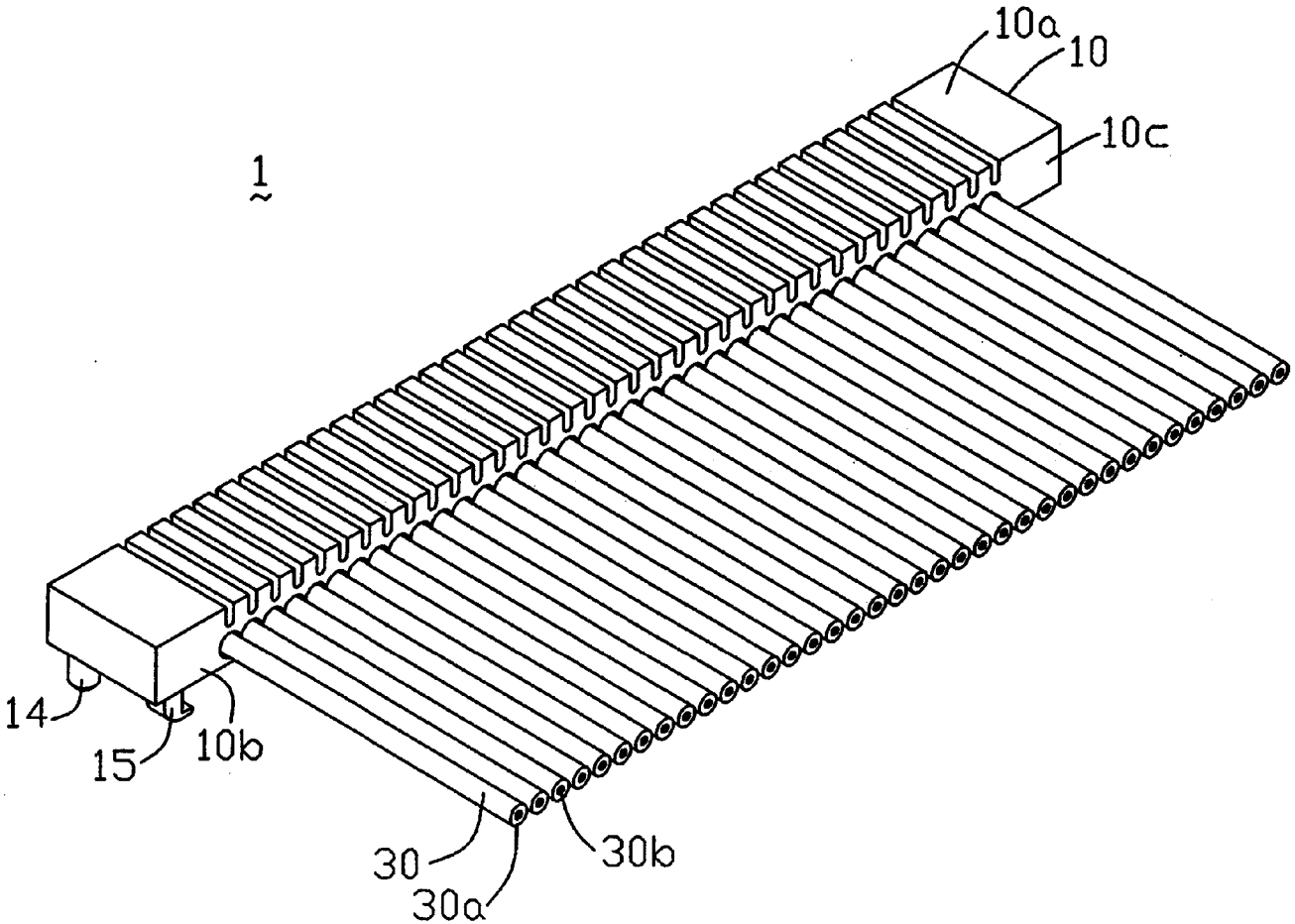
FIG. 3 is similar to FIG. 1 viewed from a reverse direction and with conductive wires assembled therein.
Figure 4:
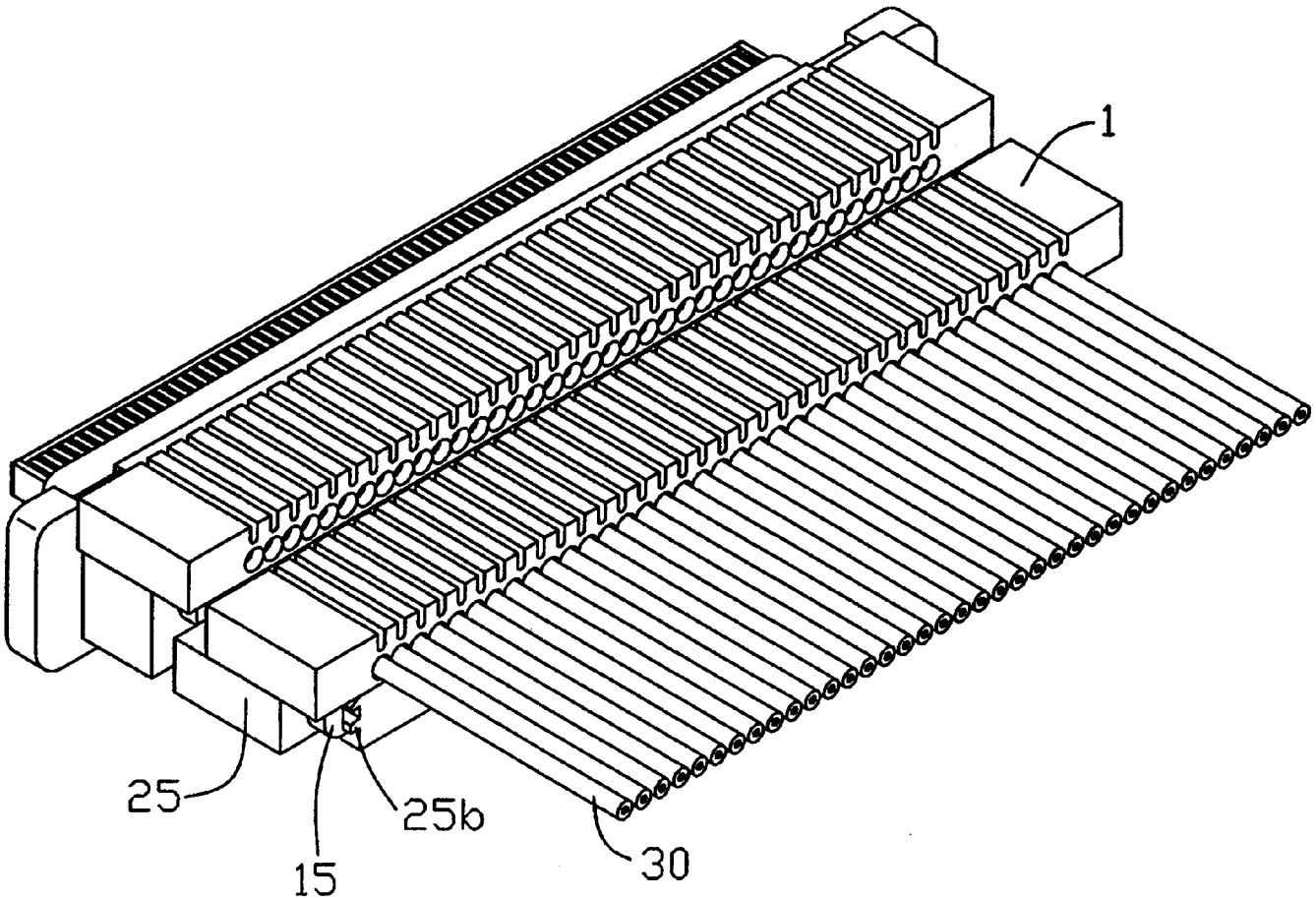
FIG. 4 is an assembled view of FIG. 3.

Referring to FIGS. 3 and 4, the conductive wires 30 are firstly assembled to the channels 11, then the spacer 1 is assembled to the termination face 26 whereby the conductors 30*b* of the conductive wires 30 are terminated with the insulation displacement section 27 of the connector core 25.

Figure 5:
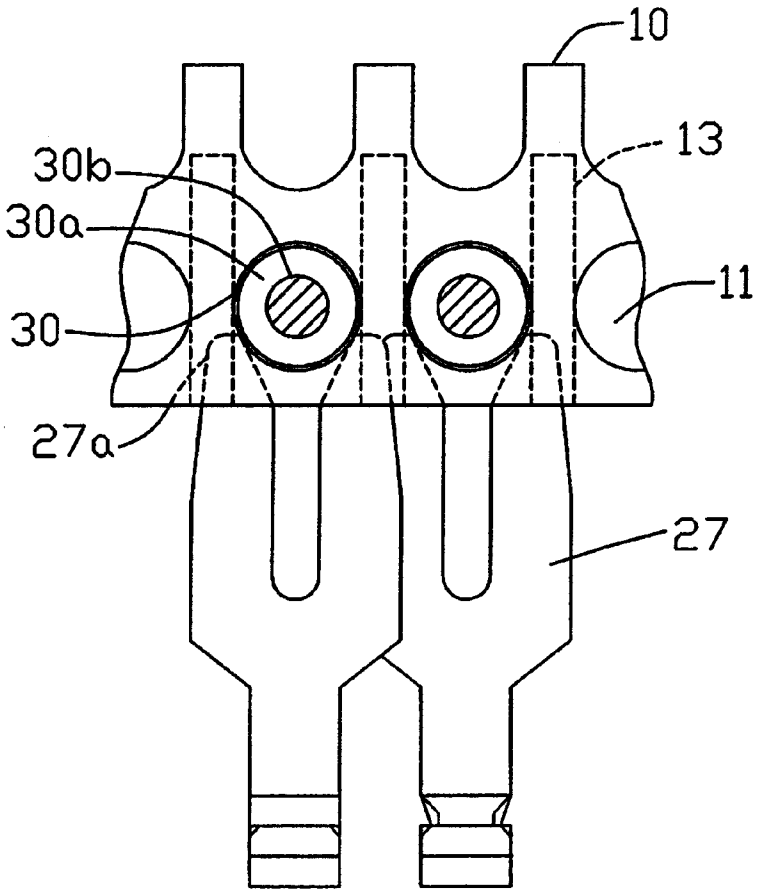
FIG. 5 is a sketch view showing terminating status between the spacer and insulation displacement sections.

Referring to FIG. 5, when the latch 15 of the spacer 1 is located at the first position of the hook 25*b*, a top portion 27*a* of the insulation displacement section 27 extends into the corresponding slit 13 and is in contact with the insulation layer 30*a* of the conductive wire 30. When the spacer 1 is moved further downward, the latch 15 is moved from the first position to the second position such that the insulation displacement section 27 pieces through the insulation layer 30*a* and makes an electrical contact with the conductor 30*b*.

The advantage of the instant application is since the conductive wires 30 are completely received in the channels 11, termination can be effectively performed. This is also beneficial for later over-molding process. In addition, the insulation displacement sections 27 are supportably received in the corresponding slits 13, during the terminating process, the insulation displacement sections 27 are well protected without any deformation thereby benefiting reliable termination between the insulation displacement sections 27 and the conductive wires 30.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claimed is:

1. A spacer for terminating conductors of conductive wires to insulation displacement sections of terminals positioned in a housing of a connector by assembling said spacer to a termination face of said housing, said spacer comprising:

an elongate base defining upper, lower, front and rear faces;

an array of channels defined in said front face;

an array of slits defined in said lower face and each communicating to a corresponding channel; and an array of retaining slots defined in said lower face and each retaining slot being in alignment with a corresponding one of said channels;

wherein said channels extend about two thirds of a width of said base;

wherein an inner diameter of each said channel is dimensioned to snugly fit the respective conductive wire therein;

wherein a width of a front end of each retaining slot is smaller than the outer diameter of the respective conductive wire.

* * * * *